US006311623B1

(12) United States Patent
Zaruba

(10) Patent No.: US 6,311,623 B1
(45) Date of Patent: Nov. 6, 2001

(54) POWER-PACKED ARROWHEAD

(76) Inventor: Wenzel Zaruba, 1027 Woodland Lakes, Milford, PA (US) 18337

( * ) Notice: Subject to any disclaimer, the term of this patent is extended or adjusted under 35 U.S.C. 154(b) by 0 days.

(21) Appl. No.: 09/447,168

(22) Filed: Nov. 22, 1999

Related U.S. Application Data

(63) Continuation-in-part of application No. 08/926,075, filed on Sep. 2, 1997.

(51) Int. Cl.[7] ..... F41G 1/467
(52) U.S. Cl. ..... 102/371; 102/371
(58) Field of Search ..... 102/372

(56) References Cited

U.S. PATENT DOCUMENTS

| | | | | |
|---|---|---|---|---|
| 2,620,190 | * | 12/1952 | Bean | 102/371 |
| 2,708,860 | * | 5/1955 | Arpin | 102/371 |
| 2,940,759 | * | 6/1960 | West | 102/371 |
| 2,970,399 | * | 2/1961 | Frohlich et al. | 102/371 |
| 3,580,172 | * | 5/1971 | Hendricks | 102/371 |
| 3,599,569 | * | 8/1971 | Heartness | 102/371 |
| 3,838,532 | * | 10/1974 | Prodanovich | 102/371 |
| 3,878,788 | * | 4/1975 | Sam | 102/371 |
| 4,729,320 | * | 3/1988 | Whitten, III | 102/371 |
| 4,762,328 | * | 8/1988 | Beyl | 273/420 |
| 4,882,995 | * | 11/1989 | Henriksen et al. | 102/371 |

* cited by examiner

*Primary Examiner*—Charles T. Jordan
*Assistant Examiner*—Lulit Semunegus
(74) *Attorney, Agent, or Firm*—Graham, Curtin & Sheridan; Richard T. Laughlin, Esq.

(57) ABSTRACT

An arrow is provided with a head that will take game in a more humane way and without long suffering. This new arrowhead is a dual powder-charged multiple-strength powered projectile that is activated after a delayed interval. As a result of the unleashed power caused by this activation, the arrowhead's bullet housing point will just flare out and the cases will induce powerful venting to rupture the vital organs nearby, or it will flare out and separate itself from the rest of the housing, the tissue anchored arrowhead causing damage by its path forward. Because all this action occurs inside the game's body, it is silent but gravely stunning to all organs. The result is on the spot drop and expiration, with minimal suffering and positive retrieval.

16 Claims, 2 Drawing Sheets

POWER-PACKED ARROWHEAD

This application is a continuation-in-part of application Ser. No. 08/926,075 filed Sep. 2, 1997.

FIELD OF THE INVENTION

The invention generally relates to an arrowhead for bow or crossbow hunting and, in particular, the invention relates to an arrowhead powered by a rim-fired cartridge like those used in powder-powered tools.

BACKGROUND OF THE INVENTION

Bow hunting and cross-bow hunting are rapidly growing in popularity. Many archers take to the game lands to hunt. However, even with today's advanced equipment, the maximum distance from which one can take game successfully is not over 30 yards, and then only if the arrow is well-placed into a vital area without any bone obstruction. As is apparent, a bone will interrupt the arrow's penetration. If this happens, the shot becomes just a wounding shot and the game will run off into the woods and later perish. There is a need to end this waste and suffering.

U.S. Pat. No. 2,940,759 issued Jun. 14, 1960 to L. J. West discloses a power head arrow which is powdered by a series of child's cap pistol caps to give extra force to the arrowhead and disconnect the shaft. Such caps have a minimal amount of force. In accordance with the disclosure when the arrowhead contact the animal the reduction of speed of the arrowhead will cause explosion of the caps by the shaft continuing its velocity. The caps go off when the arrowhead strikes the animal and it is not seen how this explosive force will go into the direction of the arrowhead rather than in the reverse direction towards the shaft which, according to the patentee, disconnects with the arrowhead.

U.S. Pat. No. 2,620,190 issued Dec. 2, 1952 to D. Bean relates to a dart or arrow which has a sleeve protecting the tip. When the sleeve contacts the target a spring or other movement device causes the tip to extend beyond the sleeve and penetrate the surface of the target. Bean also discloses the use of his sleeve device for causing the discharge of a bullet into the target. He suggests the addition of pointed tines which will secure the device to the target after impact. This securing does not take place until after the contact which causes the bullet to discharge. U.S. Pat. No. 4,882,995 issued Nov. 28, 1989 to Henriksen et al relates to a harpoon with two explosive devices in its head with a time delay fuse for the second charge. Various mechanical device are disclosed for preventing the second charge from going off by mistake. The first charge goes off at the first contact. U.S. Pat. No. 4,729,320 issued Mar. 8, 1988 to Robert G. Whitten III discloses the use of a blank cartridge for aiding penetration of an arrowhead. The blank cartridge is exploded by contact with the surface of the target. U.S. Pat. No. 2,708,860 issued May 24, 1955 to J. W. Arpin discloses a power spear or harpoon with a blank cartridge powder charge which goes off when the spear hits the target.

SUMMARY OF THE INVENTION

According to the present invention, an arrow is provided with a head that will take game in a more humane way and without long suffering. This new arrowhead contains a powder cartridge which is conventionally used in powder activated cartridge powder tools. The explosion of the charge causes the arrowhead to separate itself from the arrow shaft. It is essential to the invention that the arrowhead penetrate a substantial distance into the body of the animal before the cartridge explodes, otherwise it will be ineffective to produce the result intended. As a result of the unleashed power, the arrowhead will penetrate deep inside the body of the game. Because the venting or separation occurs inside the game's body, it is silent but gravely stunning to all organs nearby. The result is on the spot drop and expiration, with minimal suffering and positive retrieval.

As indicated, in order to make the cartridge charge successful in accomplishing the desired result it is necessary for the arrowhead to penetrate a substantial distance into the animal. Without such penetration the explosion of the charge will cause the arrowhead to be dislodged or do substantial damage to the surface of the animal's hide without killing the animal. A penetration of at least one inch and preferably at least two inches into the body of the animal before the explosion is necessary to effect the advantages of the invention.

The arrowhead is activated by the powder or carbon dioxide gas and will take any big game successfully. The performance of the projectile can be varied by alteration of the shape of the cartridge housing, or the choice of different loads of the powder cartridge—six choices, progressively higher and higher in low velocity loads, and six choices progressively higher and higher in high velocity loads—color-coded for strength. This gives the hunter a last moment choice to select the load suitable to the game size. The activation of the power is done at the a defined interval after impact with the game body and at a depth determined by the speed and the weight of the arrow shaft and the resistance of the body of the game target. Since the activation occurs inside the games body it is silent but gravely stunning to all internal organs near the contact point.

Applicant's invention differs from the prior art in that all of the prior art use a blank cartridge with only the primer as the main charge. None of the references mention the second charge. Also, none of the references mention 12 different choices of powder loads. Further, none of the references deal with the problem of recoil since they are mostly underwater spears with the spear handle being heavier than a shaft of an arrow. Recoil is most pronounced by light objects like darts and arrows. The recoil is very important since it not only affects the penetration but also the ability of the arrowhead to stay in the game and effect the kill. The device used to control the degree of penetration is important. In Applicant's invention the penetration is controlled by the length of the trigger sleeve 50*a*. A longer sleeve gives deeper penetration. Further, Applicant's structure is readily assembled by hand. The arrowhead shown in FIGS. 5 and 6 feature means to exchange the bullet housing with the powder charge according to the game size (stronger or weaker loads) by just unscrewing the bullet housing from the main head housing, and replacing it with the charge desired. In applicant's invention the whole arrowhead with part of the shaft is inside the game body and then the charge is triggered. The use of four or more prong springs is an important recoil absorbing means.

The novel features which are believed to be characteristics of the invention, both as to its organization and method of operation, together with further objects and advantages thereof, will be better understood from the following descriptions in connection with the accompanying drawings in which the presently preferred embodiments of the invention are illustrated by way of examples. It is expressly understood, however, that the drawings are for purposes of illustration and description only and are not intended as a definition of the limits of the invention.

DESCRIPTION OF THE PREFERRED EMBODIMENT

Figure 4:
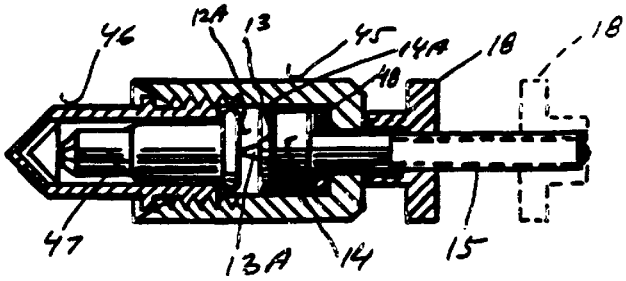
FIG. 4 is a side elevation view partly in section of another modification of the arrowhead made in accordance with the invention.
Figure 5:
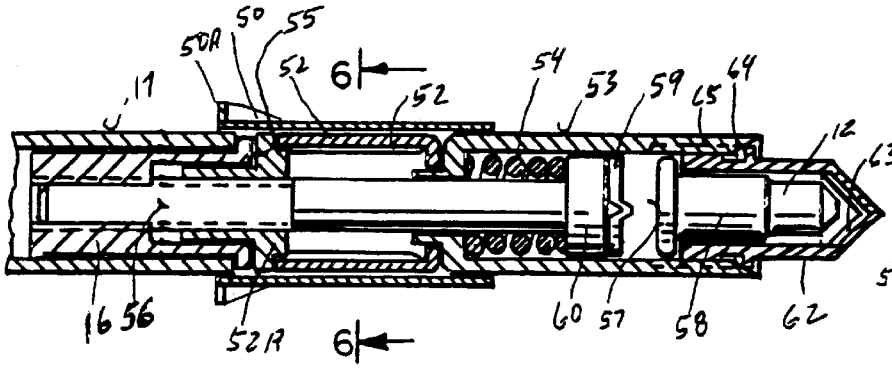
FIG. 5 is a side elevation view partly in section of another modification of the arrowhead made in accordance with the invention.
Figure 6:
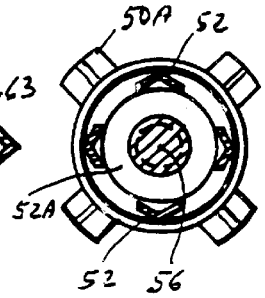
FIG. 6 is an end view of the modification shown in FIG. 5 taken along lines 6—6 of FIG. 5.
Figure 7:
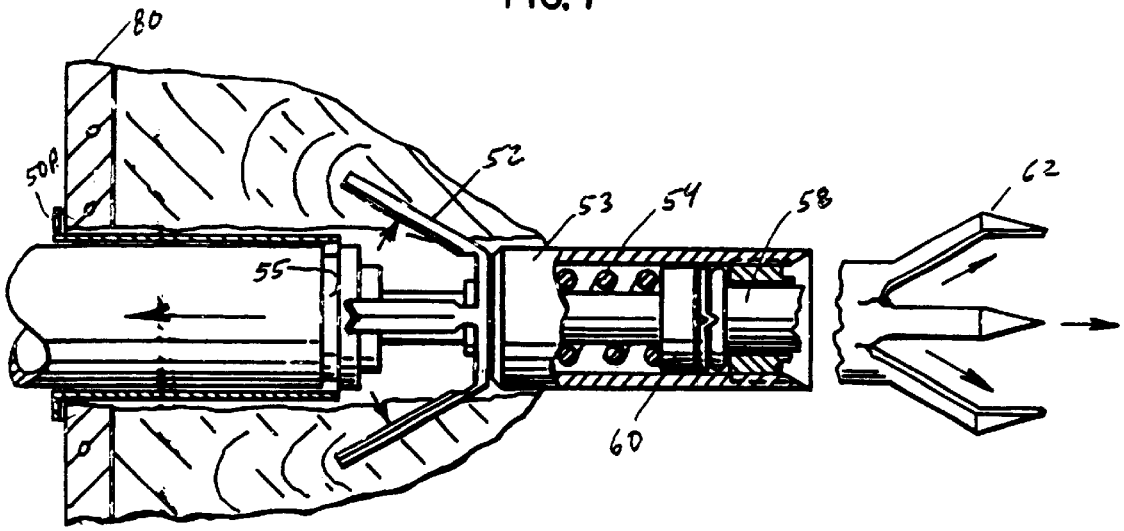
FIG. 7 is a side elevation view partly in section of the modification of the arrowhead shown in FIG. 5.
Figure 8:
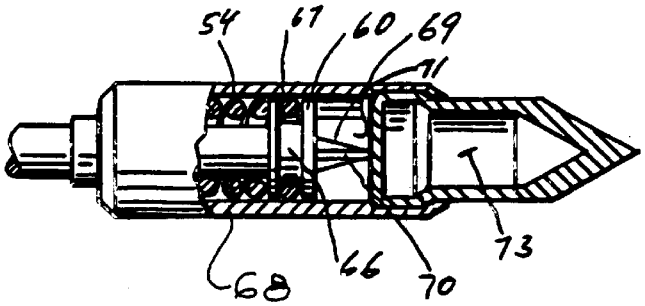
FIG. 8 is a side elevation view partly in section showing a second stage of the device shown in FIG. 7.

This invention can have at least six different configurations. The modification shown In FIG. 1 of the drawings has an arrowhead which is used just once. The modification shown in FIG. 2 of the drawings has an arrowhead with a means of reloading for reuse. The modification shown in FIG. 3 of the drawings has an arrowhead with a means of reloading with a rim-fired or center-fired cartridge. The modification shown in FIG. 4 illustrates an arrowhead with a threaded cartridge housing in the main part of the housing. Located behind the plunger head is a spring washer which, when released, will exhort pressure against the rim of the powder cartridge and the chisel like extension to make the arrowhead more sensitive at lower impact resistence. FIG. 5 illustrates the arrowhead or broadhead means to trigger activation by the trigger sleeve at the predetermined depth. FIG. 6 illustrates a four-prong spring in its captive position. FIG. 7 illustrates the arrowhead shown in FIG. 5 after actuation. FIG. 8 illustrates carbon dioxide version as shown in FIG. 5.

A bullet-shaped arrowhead housing 10 containing in its small cavity 11 a rim-fired cartridge 12 (not in section). This type of cartridge is conventionally used in powder-powered or charge activity tools. Referring to the drawings, the cartridge 12 has a rim 12*a* resting on the step 11*a* of the large cylinder cavity 13*b*. Right behind the rim 12*a* is a stamped out washer 13 with chisel-like extension 13*a* on its edge. The washer 13 with its chisel-like extension is held in place and against the rim 12*a* with the face 14*a* of the plunger 14. The plunger 14 is able to slide into this larger cylinder cavity 13*b*. All the aforementioned components, i.e., cartridge 12, washer 13 and plunger 14, are closed inside the bullet-shaped housing 10. This whole assembly is backed up by bushing 19 and held together by a crimp 20. The end portion of the plunger 15 is screwed into the arrow shaft adaptor 16. In order to dampen the backfire shock, a backup nut is utilized. The backup nut 18 is threaded over the smallest threaded part 15 of the plunger 14. The projectile is shown in phantom 21 a after separation. It is more economical to stamp out the washer with the chisel-like extrusion than to machine it onto the face 14*a* of the plunger 14. This cost saving is a valuable component of the invention.

In use, the weight of the arrow shaft, moving at approximately 250 feet per second, collides with the target. The plunger 14 attached to the arrow shaft 17 slams the washer 13 with the chisel-like extension against the cartridge rim 12 containing a primer. The rim is now squashed against the housing step 11*a* and the chisel-like extension of the washer 13. This force will ignite the primer and the charge and the separation of the arrowhead starts. The housing 10 moves over the large cylinder part of the plunger 14 opening the crimp 20. The crimp 20 will open just enough to allow the plunger 14 to pass through. This action has the same effect as when a bullet passes through a gun barrel.

Figure 1:
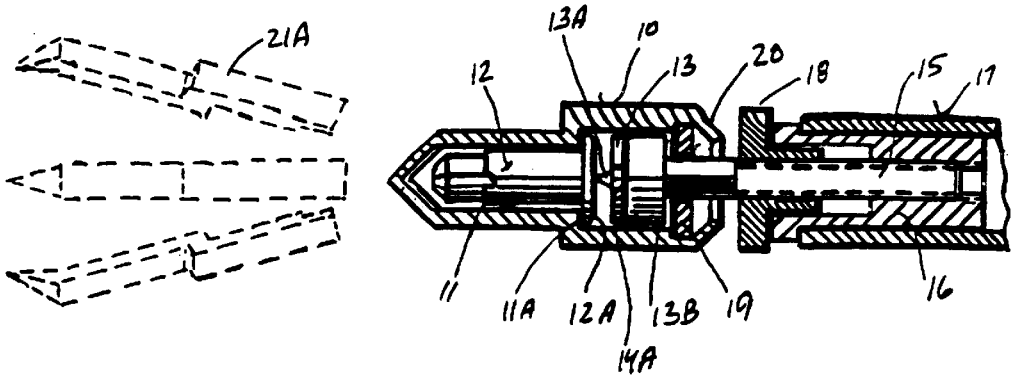
FIG. 1 is a side elevation view partly in section of one arrowhead made in accordance with the invention with the projectile after firing shown in dashed lines.
Figure 2:
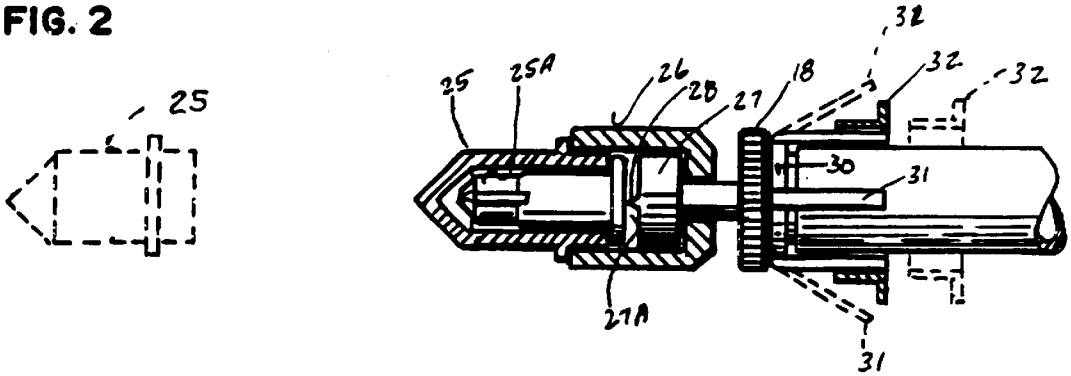
FIG. 2 is a side elevation view partly in section of another modification of the arrowhead made in accordance with the invention.

FIG. 2 of the drawings is a sectional view of the arrowhead with a reloading means. The housing consists of two parts. The bullet 25 is pressed or fastened with adhesive into the main housing 26. The plunger 27 has a chisel-like protrusion 28 machined into the face 27*a*, or, if preferred, the washer 13, as shown in FIG. 1, could be used. The bullet 25 has a rim-fired cartridge 29 in its cavity 25*a*. As shown in FIG. 1, in order to use the arrow shaft recoil to some useful task a four prong spring 30 is held captive against the shaft 17 by the backup nut 18. The four prongs 31 are held down by shouldered sleeve 32. When the sleeve 32 is pushed off the prongs by the game hide, the prongs will expand and anchor itself in the surrounding tissue, providing an anti-recoil platform and also causing damage by the recoil.

After each use, the bullet 25 and the cartridge 29 are replaced so long as the condition of the housing 26 and the plunger will permit. The sequence of events after impact is same as described before with one exception: Only the bullet part 25 will separate from the housing 26 and the plunger 27.

Figure 3:
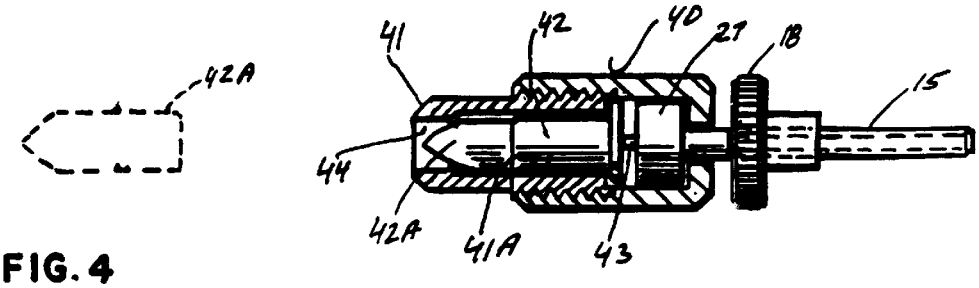
FIG. 3 is a side elevation view partly in section of another modification of the arrowhead made in accordance with the invention.

Referring to FIG. 3 of the drawings, also a sectional view of the arrowhead showing the means of reloading with a bullet-yielding cartridge, a housing 40 threaded in short barrel 41. In the barrel chamber 41*a* is a rim-fired or center-fired cartridge 42 with the bullet 42*a*. The plunger 27 also has a chisel-like extension on its edge for rim-fired ammunition or a pin-like extension in the center of the plunger. The nuzzle 44 of the barrel is narrowed down and could be provided with rifling to assure powerful separation. The sequence of the operation is the same as described in the previous text, except that the bullet 42*a* leaves the barrel 41 as shown in phantom view 42*a*. The outside diameter of the barrel 41 and the outside of the housing 40 is straight knurled for a good grip when reloading.

Referring to FIG. 4, a means for more sensitive activation with a lower impact resistance is shown. The device can be assembled by the user to give the user the discretion in selection of the type of tip or strength of the charge. As an illustration, it could be used without the option of impact sensitivity and with the anti-recoil spring as shown in FIG. 2.

The main housing 45 is inside threaded to receive the cartridge housing 46 containing cartridge 47. The washer 13 with a chiseled extrusion 13*a* is held in place and against the rim 12*a* with the face 14*a* of the plunger 14. Located behind the plunger 14 is a spring washer 48 in compressed mode by the new reversed backup nut 18. When the whole broadhead is assembled as shown in FIG. 4, and just before the actual use, the backup nut is removed and screwed back reversed over the threaded part of the plunger 15 as far as it goes. This latter construction can be seen clearly in FIG. 4. The pressure of the spring washer 48 is now released against the chisel exterior 13*a* and rim 12*a*. This force will provide the sensitivity of activation with the lower impact resistance.

Referring to FIG. 5, a trigger means is illustrated which is the preferred embodiment of the invention. This version is not able to be activated at the impact with the game body but at the given depth of penetration. This depth of penetration has to be substantial, such as one inch If the explosion takes place too close to the surface all of the force will be a discharge backwards and serve no useful purpose. The depth of the penetration is indicated by the length of the trigger sleeve 50 longer-deeper. When the broadhead enters the game body the trigger sleeve 50 is stopped by the four prong flange 50*a* at the hide 80 of the game. When the trigger sleeve 50 exposes the four prongs of the spring 52 the prongs release from the holding position against the retaining nut 52*a* as illustrated in FIG. 7. The four prongs expand and this spring 52 becomes an anti-recoil platform. Also at this instance, the main housing 53 being under the compressed tension of the spring 54 moves forcibly in the direction of the arrow shaft end 55 to which the plunger 56 is fastened. This forceful action will compress the primer in the rim 57 of the cartridge 58. With the fire disk 59 fastened to the plunger head 60 the powder in the cartridge ignites and the force will crack the cartridge housing 62 in pre-determined areas where deep stakes 63 are provided inside the nose cone. During this action, the cracked housing 62 will flare out at its point as shown in FIG. 7, but will not separate from main housing 53. By the flare out, a powerful venting is induced to all vital organs nearby. Venting is sufficient for smaller animals like white-tail deer. When flare out and separation of the housing 62 from the housing 53 is required, an undercut 64 provided for this purpose right at the threaded part 65. While the cracked and separated housing contains its path forward causing damage the recoil of the arrow shaft assembly is causing damage to the tissue around the exit opening by the extended prongs of the spring 52 as illustrated in FIG. 7. This FIG. 8 also illustrates the trigger action shown in FIG. 6. The plunger head 60 is provided with an "O" ring groove 66 holding "O" ring 67 to assure the air tightness to the chamber 68. The end 61 of the plunger head has a sharp conical pin 69 to provide four bleed grooves 70. These grooves allow the carbon dioxide gas to escape into the chamber 68 when the back wall 71 of the bullet shaped container 72 containing the gas is pierced. The compressed gas 73 will force the bullet shaped container 72 out of its captive position which is fastened by a crimp or adhesive.

FIG. 6 in addition to showing the trigger sleeve 50 with the four flange prongs 50*a*, also is illustrated the four prong spring resting on the cylindrical undercut of the retaining nut 52*a*.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. In an arrow to be utilized with a bow for penetrating and killing game comprising a shaft, means for guiding the shaft in a controlled manner as it passes through the air, an arrowhead for piercing and penetrating the body of an animal and an explosive charge in the arrowhead for improving penetration of the arrowhead into the animal, the improvement which comprises taking the animal in a more humane way and without long suffering, means for controlling the depth of penetration of the arrowhead into the animal to allow at least one inch of penetration, triggering means activated when the desired degree of penetration is obtained to activate the explosive charge, and means for minimizing the recoil of the arrowhead caused by the explosion of the power means.

2. The arrowhead as defined in claim 1 wherein the power means is a dual explosive powder cartridge.

3. The arrowhead as defined in claim 1 wherein the power means is carbon dioxide gas.

4. The arrowhead as defined in claim 1 wherein the power means is reloadable.

5. The arrowhead as defined in claim 1 wherein the power means is a rim-fired or center-fired explosive cartridge.

6. An arrowhead for penetrating and killing game in a more humane way and without long suffering which comprises a shaft, means for guiding the shaft in a controlled manner to the animal upon firing from a projection device, an arrowhead affixed to the shaft for piercing the hide of the animal, power means for driving at least a portion of the arrowhead into the animal after contact with the animal, means for controlling the discharge of the power means to allow the desired degree of penetration into the animal of at least one inch of the arrowhead prior to discharge and means for minimizing the amount of recoil of the arrowhead.

7. The arrowhead as defined in claim 6 wherein the power means is an explosive powder charge which ignites after the contact with the animal.

8. The arrowhead as defined in claim 6 wherein the power means is a gas.

9. The arrowhead as defined in claim 8 wherein the power means is carbon dioxide gas.

10. The arrowhead as defined in claim 6 wherein the power means is reloadable.

11. The arrowhead as defined in claim 7 wherein the power means is a rim-fired or center-fired explosive cartridge.

12. The arrowhead as defined in claim 6 wherein the arrowhead comprises a housing, a threaded cartridge as part of the housing, a plunger located in the housing, a spring washer which when released will exert pressure against the rim of the powder cartridge and a chisel like extension on the front of the housing to make the arrowhead more sensitive at lower impact resistence.

13. The arrow as defined in claim 12 containing trigger activation means in the housing to predetermined the depth of penetration of at least a portion of the arrowhead into the animal.

14. The arrowhead as defined in claim 12 wherein a four prong spring means maintains the arrowhead in an anti-recoil position.

15. The arrowhead as defined in claim 14 wherein the housing is bullet-shaped, a rim-fired cartridge in the housing, the rim resting on a step of the housing, a stamped out washer with chisel-like extension on one edge, the washer being held in place against the rim with a face of a plunger, the plunger slidably mounted in the housing.

16. A method of killing game animals with a bow and arrow in a humane manner comprising utilizing an arrowhead on the arrow which contains an explosive charge, shooting the arrowhead into the animal, means for permitting the penetration of the arrowhead into the animal of a depth of at least one inch, exploding the charge after penetration of the arrowhead into the animal to the depth selected, thereby driving at least a portion of the arrowhead further into the body of the animal, and minimizing the recoil of the arrowhead as a result of the explosion.

* * * * *